United States Patent [19]

Skelly et al.

[11] 4,403,011

[45] Sep. 6, 1983

[54] PROCESS FOR THE TREATMENT OF WOOL CONTAINING MATERIAL

[75] Inventors: James K. Skelly; George C. Philpott, both of Wilmslow, England

[73] Assignee: Ciba-Geigy Corporation, Ardsley, N.Y.

[21] Appl. No.: 328,886

[22] Filed: Dec. 9, 1981

[30] Foreign Application Priority Data

Dec. 18, 1980 [GB] United Kingdom ..... 8040566

[51] Int. Cl.[3] ..... B32B 7/00; B05D 3/02

[52] U.S. Cl. ..... 428/264; 8/112; 8/128 A; 427/323; 427/412; 428/270; 428/287; 428/447; 428/473; 428/474.4; 428/475.2

[58] Field of Search ..... 427/389, 407.1, 412, 427/387, 323; 8/112, 128 A; 428/264, 270, 287, 248, 249, 447, 473, 474.4, 475.2

[56] References Cited

U.S. PATENT DOCUMENTS 3,832,228 8/1974 Gardiner et al. ..... 8/128 A X
3,876,459 4/1975 Burrill ..... 8/127.6 X

FOREIGN PATENT DOCUMENTS 746307 3/1956 United Kingdom .
766864 1/1957 United Kingdom .
865727 4/1961 United Kingdom .
1125486 8/1968 United Kingdom .
1192553 5/1970 United Kingdom .
1300505 12/1972 United Kingdom .
1315820 5/1973 United Kingdom .
1358836 7/1974 United Kingdom .
1379203 1/1975 United Kingdom .
1404356 8/1975 United Kingdom .
1510145 5/1978 United Kingdom .
1543157 3/1979 United Kingdom .
1565353 4/1980 United Kingdom .

*Primary Examiner*—Thurman K. Page
*Attorney, Agent, or Firm*—Edward McC. Roberts

[57] ABSTRACT

A process for treating wool containing materials to prevent or reduce felting shrinkage comprises applying to the material in two separate steps a first polymer which is (A) a dialkyl polysiloxane diol containing aminoalkyl groups, or (B) a poly(alkylene oxide) polythiol, and a second polymer which is (A) a dialkyl polysiloxanediol containing aminoalkyl groups or (C) a polyamide, the second polymer being different from the first polymer.

11 Claims, No Drawings

PROCESS FOR THE TREATMENT OF WOOL CONTAINING MATERIAL

The present invention relates to a process for the treatment of wool to prevent or reduce felting shrinkage.

A number of processes are known and in common usage for producing shrink resistant effects on wool fibres. Essentially these fall into two groups:

In the first group of processes, wool fibres are treated in an aqueous oxidative medium during which the surface scale structure of wool fibres undergoes modification. The chemicals used for this type of process are those that act as a source of hypochlorous acid, e.g. an alkali metal hypochlorite or dichloroisocyanurate. Alternatively, an alkali metal permanganate, permonosulphuric acid or ozone may be used. Such processes produce wool fabrics that exhibit less tendency to felt, and therefore shrink, than natural wool fibres. This control of felting can be further enhanced if the application of an oxidative treatment is followed by the application of a polyamide epichlorhydrin resin or with a resin of the type described in British patent specification No. 1,192,553.

In the second group of processes, wool is treated with polymeric products. Such processes produce a thin film of polymeric material that masks the scale structure or will form fibre-fibre bridges between adjacent fibers thus impeding their movement relative to one another. Processes in which wool is given a severe oxidative chemical treatment, suffer the disadvantage that the surface of the wool fibre is degraded to some extent resulting in a loss in elasticity, recovery from deformation, resistance to abrasion, strength, dye fastness and weight. Furthermore, the handle of wool treated in this manner is less attractive than that of wool which has not been chemically treated.

The use of polymeric materials as a medium for imparting shrink resistance can also present problems. For example, it is difficult to produce a thin film of polymeric material uniformly over the fibre surface. Thus careful process control is generally required to produce the necessary degree of film uniformity and hence the required degree of shrink resistance. Furthermore, the durability of such films, when subjected to mechanical wet processing may not always meet the more rigorous standards of shrink resistance demanded by the industry.

The process of the present invention provides an improved method for applying polymeric materials whereby the degree of shrink resistance imparted is more reproducible and where the amount of polymeric material required to produce a given level of shrink resistance can be reduced, thus minimizing the effect on handle of the treated fabric.

Accordingly, the present invention provides a process for treating wool containing materials which comprises applying to the material in a first step an aqueous composition containing a total amount of 0.25 to 6 percent by weight of a first polymer which is (A) a dialkyl polysiloxane diol containing aminoalkyl groups or (B) a poly(alkylene oxide) polythiol, and in a second step an aqueous composition containing a total amount of 0.1 to 4 percent by weight of a second polymer which is different from the first polymer and which is (A) a dialkyl polysiloxane diol containing aminoalkyl groups, or (C) a polyamide resin such as polyamide epichlorhydrin resin or a polyamido polyamide resin, the indicated percentage being related to the solids content of the polymers in the compositions in relation to the weight of the material to be treated.

The first polymer provides the basic non-felting effect, while the second polymer reinforces and enhances the effect of the first, in many cases providing a synergistic effect.

It should be noted that the dialkyl polysiloxane diols containing aminoalkyl groups as polymer (A) can act either as the primary shrink resist agent or as the secondary agent in conjunction with the other polymers (B) and (C).

The various polymers (A), (B) and (C) used in the process of the invention are known products, all of which have been described for use in treating wool by various methods, such as those outlined above. In this connection, we would refer to U.S. Pat. Nos. 3,876,459 and 3,832,228 and British patent specification Nos. 1,543,157, 1,510,145, 1,404,356, 1,315,820, 1,300,505, 1,125,486 and 865,727, which are merely examples of specifications which describe the various resins which can be used in the present invention.

Thus when a dialkyl polysiloxane diol containing aminoalkyl groups is used as polymer (A) it may be a polydiorganosiloxane having a molecular weight of at least 2500 and terminal silicon-bonded —OX radicals wherein X represents a hydrogen atom or an alkyl or alkoxyalkyl radical having up to 15 carbon atoms, at least two of the silicon-bonded substituents present in said polydiorganosiloxane being monovalent radicals composed of carbon, hydrogen, nitrogen and, optionally, oxygen, which radicals each contain at least two amino groups and are attached to silicon through a silicon to carbon linkage, and at least 50 percent of the total silicon-bonded substituents in said polydiorganosiloxane being methyl radicals, any remaining substituents being monovalent hydrocarbon radicals having from 2 to 20 inclusive carbon atoms. Such polydiorganopolysiloxanes as polymer (A) and preferred embodiments thereof are specifically disclosed in British patent specification No. 1,543,157.

The polysiloxane may be used in conjunction with a compound (A′) which cross-links with the polysiloxane. Such a cross-linking compound may be, for example, an organosiloxane having at least three silicon-bonded hydrogen atoms in the molecule and in which the organic radicals are alkyl radicals having less than 19 carbon atoms. Cross-linking compounds of this kind as well as preferred embodiments thereof are also described in British patent specification 1,543,157.

Alternatively, the cross-linking compound (A′) may be an organosilane of the general formula $$YSi[Y']_n[X]_{3-n} \quad (1)$$

wherein Y represents a monovalent radical composed of carbon, hydrogen, nitrogen and, optionally, oxygen, which radical contains at least two amine groups and is attached to silicon through a silicon to carbon linkage, Y′ represents an alkyl radical or an aryl radical, each X represents an alkoxy radical having from 1 to 14 inclusive carbon atoms and n is nil or 1, and/or a partial hydrolysate and condensate of said organosilane. The compound (A′) of the formula (1) and preferred embodiments thereof are specifically disclosed in U.S. patent No. 3,876,459.

The poly(alkylene oxide) polythiol as polymer (B) may be an ester containing at least two mercaptan (-SH) groups per molecule, obtainable e.g. by reaction of (a) a monomercaptodicarboxylic acid, or its anhydride, and (b) a substance containing at least two alcoholic hydroxyl groups or one 1,2-epoxide group.

The monomercaptodicarboxylic acid (a) is usually of formula $$\mathrm{HOOC{-}\underset{\underset{\mathrm{SH}}{|}}{R_o}{-}COOH} \qquad (2)$$

wherein $R_o$ represents a trivalent aliphatic or alicyclic radical, the indicated carboxyl groups and mercaptan groups being directly linked to a carbon atom of the group $R_o$, and preferably it is thiomalic acid.

The substance containing at least two alcoholic hydroxyl groups (b) include ethylene glycol, propylene glycol, propane 1,3-diol, butane-1,2-diol, butane-1,3-diol, butane-1,4-diol, poly(oxyethylene) glycols, poly(oxypropylene) glycols, poly(oxybutylene) glycols, poly(oxy-1,1-dimethylethylene) glycols, poly(epichlorohydrins), glycerol, 1,1,1-trimethylolethane, 1,1,1-trimethylolpropane, hexane-1,2,5-triol, hexane-1,2,6-triol, 3-hydroxymethylpentane-2,4-diol, pentaerythritol, mannitol, sorbitol, and adducts of ethylene oxide or propylene oxide with such alcohols, including mixed polyhydric polyethers obtained by treating an initiator containing active hydrogen, such as ethylene glycol, with say, propylene oxide, and then reacting the adduct with a second alkylene oxide, say, ethylene oxide.

Mono-1,2-epoxides which may be used in place of a dihydric alcohol include: ethylene oxide, propylene oxide, butylene oxide, 1,1-dimethylethylene oxide, and epichlorohydrin; glycidyl ethers of alcohols, such as n-butyl and iso-octyl glycidyl ethers, or of phenols, such as phenyl and p-tolyl glycidyl ethers; N-glycidyl compounds such as N-glycidyl-N-methylaniline or N-glycidyl-n-butylamine; and glycidyl esters of carboxylic acids, such as glycidyl acrylate and glycidyl acetate. The starting materials (a) and (b) and the reaction products thereof as possible feature of the polymer (B) as well as preferred embodiments thereof are specifically disclosed in British patent specification No. 1,315,820.

Other suitable poly (oxyalkylene oxide) polythiols as polymer (B) are those of the formula $$\mathrm{R\{{-}(O)_a{-}CO{-}[(O)_b{-}R_1{-}(O)_b{-}CO{-}(O)_a{-}R_2{-}(O)_a{-}CO]_c{-}\underset{\underset{{}_e\{\mathrm{HOOCR_4{-}O_{da}{-}[OC{-}(O)_b{-}R_3]_d}}{|}}{(O)_b}{-}} \qquad (3)$$

where a and b are each zero or 1 but are not the same c is zero or a positive integer d is zero or 1 e is an integer of from 1 to 6

R, $R_1$, $R_2$, $R_3$ and $R_4$ each represent a saturated aliphatic group, which may be a straight or branched chain, which may be substituted by alkyl, aryl, haloalkyl, hydroxyl, mercaptan, or carboxyl groups and which may be interrupted in the chain by —O— or —OCO— units, the said aliphatic groups being linked through carbon atoms to the indicated —O— and —CO— groups, at least one of the groups R, $R_1$, $R_2$, $R_3$ and $R_4$ containing at least one mercaptan group, with the provisos that there are more than two, and preferably at least three, mercaptan groups per average molecule and that, when e is 1, at least one of the groups R, $R_1$, $R_2$, $R_3$ and $R_4$ contains a carboxylic acid group.

Preferred compounds of the formula (3) can be obtained by esterifying a dicarboxylic acid, such as a mercaptan-containing dicarboxylic acid, e.g. thiomalic acid (mercaptosuccinic acid), with a stoichiometric excess of a dihydric alcohol, such as a poly(oxybutylene)diol of average molecular weight 1000, followed by reaction of the residual hydroxyl groups with a dicarboxylic acid, which may contain a mercaptan group, or its anhydride, such as succinic anhydride.

The polythiols of the formula (3) as other possible feature of the polymer (B) as well as preferred embodiments thereof are specifically disclosed in British patent specification No. 1,510,145.

As possible feature of the polyamide resin as polymer (C) there may be used a polyamido polyamide resin which is e.g. a stable preparation of water-soluble or water-dispersible reaction product of polyepoxides, fatty amines and basic polyamides, produced by reacting (a) a reaction product of (a') at least one polyepoxide which contains at least two epoxide groups per molecule, and (a'') at least one high-molecular weight fatty amine, such that the equivalent ratio of epoxide groups to amino groups is 1:0.1 to 1:0.85 with (b) a basic polyamide which is obtained by condensation of (b') polymeric, unsaturated fatty acids and (b'') polyalkylenepolyamines, in the presence of an organic solvent, at temperatures of up to 95° C., such that the equivalent ratio of epoxide groups of the component (a) to amino groups of the component (b) is 1:1 to 1:6, with the addition of acid at some stages before completion of the reaction so that a sample of the reaction mixture has a pH value of 2 to 8 after addition of water. Polyamide resins of this kind and preferred embodiments thereof as possible polymer (C) are specifically described in British patent specification No. 1,300,505.

Other suitable polyamides as polymers (C) are polyamide epichlorhydrin resins such as codensation products obtained by reacting a polyamide derived from a polyalkylene polyamide and a saturated aliphatic dibasic carboxylic acid containing from 3 to 10 carbon atoms with epichlorohydrin alone or in conjunction with a quaternizing agent.

In the preparation of these products, the dibasic carboxylic acid is first reacted with the polyalkylene polyamine under conditions such as to produce a water-soluble polyamide containing the recurring groups of the formula $$\mathrm{{-}NH(C_mH_{2m}HN)_x{-}COACO{-}} \qquad (4)$$

where m and x are each 2 or more and A is the divalent hydrocarbon radical of the dibasic carboxylic acid. This long chain polyamide is then reacted with epichlorohydrin and optionally with a quaternizing agent to form the water-soluble condensation products. Polyamide resins containing e.g. recurring groups of the formula (4) as other possible feature of the polymers (C) as well as preferred embodiments thereof are specifically disclosed in British patent specification No. 865,727.

Other features of polyamide epichlorhydrin resins as a possible embodiments of polyamides as polymers (C) are condensation resins containing nitrogen which are obtained when in a first stage dicyandiamide or cyanamide is condensed, in the presence or absence of another compound capable of condensing with polyamines preferrably at an elevated temperature, with a polyamine containing at least three primary and/or secondary amino groups, especially with a polyalkylenepolyamine that contains in addition to at least two primary amino groups at least one secondary amine group, using preferably for every equivalent of primary amino groups of the polyamine 0.1 to 1.0 mol of dicyandiamide or 0.2 to 2.0 mols of cyanamide, whereupon in a second stage the polycondensate obtained in this manner is reacted, likewise preferably at an elevated temperature, with an epihalohydrin preferably with epichlorohydrin, using advantageously 0.3 to 3.0 mols, preferably 1 to 1.5 mols, of epihalohydrin for every equivalent of secondary amino groups of the polyamine used in the first stage of the process.

According to a preferred variant of the resins, it is also possible to modify the nitrogen-containing condensation resins by reacting the polyamine with, in addition to the dicyandiamide or cyanamide, other bifunctional compounds capable of under-going condensation with the polyamine. As such compounds there may be mentioned, for example:

Diamines, such as hexamethylenediamine; urea, formaldehyde, glyoxal, higher aldehydes such as acetaldehyde, crotonaldehyde or dicarboxylic acids, especially adipic or oxalic acid and their mono- and di-alkyl esters. These bifunctional compounds may be added at any desired point of time during the first stage of the condensation process or during the condensation of the dicyandiamide with the polyamine.

Such polyamide resins from cyandiamide or dicyandiamide, polyalkylenepolyamines and epichlorohydrin as starting materials as well as preferred embodiments thereof are specifically disclosed as most preferred feature of the polymers (C) in British patent specification No. 1,125,486.

The amounts of the different polymers (A), (B) and/or (C) required to produce the non-felting effect will vary according to the type of wool used, the yarn construction, the structure of the knitted or woven fabric and on the degree of shrink resistance required.

When a dialkyl polysiloxane diol containing aminoalkyl groups as polymer (A) is used as the first resin, it is preferably used in an amount of 0.5 to 6 percent, most preferably 1 to 4 percent by weight.

When it is used as the second polymer, it is preferably used in an amount of 0.1 to 2 percent, more preferably 0.1 to 1 percent by weight.

When a poly(alkylene oxide) polythiol as polymer (B) is used as the first resin, it is preferably used in an amount of 0.25 to 4 percent, more preferably 0.5 to 3 percent by weight.

When a polyamide epichlorohydrin resin as polymer (C) is used as the second resin, it is preferably used in an amount of 0.25 to 3 percent, more preferably 0.25 to 2 percent by weight.

When a polyamido polyamide resin as polymer (C) is used as the second polymer, it is preferably used in an amount of 0.25 to 4 percent, more preferably 0.5 to 3 percent by weight.

Higher amounts of all enumerated resins can be used, if desired, but no extra benefit is achieved and, of course, it becomes more expensive.

All the above amounts are in terms of 100 percent resin solids, based on the weight of wool treated.

The polymers (A), (B) and/or (C) may be applied to the wool in a conventional way by immersing the wool in a bath containing the resin either in aqueous solution or in the form of an aqueous emulsion. To achieve the desired result, the resins must be applied sequentially, the selected first resin being applied first and the selected second resin being applied second, since the sequence of the application is critical and represents the gist of the present invention. Reversal of this sequence or simultaneous application of the two polymers does not achieve the desired result. Preferably, the sequential application of the two resins in the two separate steps is achieved from two separate baths.

When a polyamide epichlorohydrin resin as polymer (C) is applied after a poly(alkylene oxide) polythiol as polymer (B), the greatest improvement is achieved when the second resin is applied from a fresh, separate bath after application of the first resin. In the particular case of a polyamide epichlorohydrin resin applied after an aminoalkyl substituted dimethyl polysiloxanediol as polymer (A), it is however not necessary to apply the second resin from a separate bath to obtain maximum improvement in shrink resistance.

In addition to the shrinkproofing effect, the use of two different polymers allows a wide range of handle effects to be produced. For instance, a range of soft handle effects can be produced when a polymer (A) is used as the first resin and a polyamide epichlorhydrin as polymer (C) is used as the second resin. Increasing the proportion of the polyamide epichlorhydrin produces an increasingly dry handle. A range of soft handle effects are produced when a polymer (B) is used as the first resin and a polymer (A) is used as the second resin.

A range of soft handle effects are produced when a polymer (B) is used as the first resin and a polymer (A) is used as the second resin. A range of dry handle effects are produced when a polymer (B) is used as the first resin and a polyamide epichlorhydrin resin as polymer (C) is used as the second resin. Increasing the amount of polyamide epichlorhydrin provides different degrees of dryness or scroop.

The process of the invention provides other advantages over known processes. For a given amount of polymer add-on a higher resistance to felting shrinkage is obtained. Minimal fibre degradation is incurred during processing. Therefore, the treated wool is in better condition and possesses improved wear performance characteristics.

Oxidative and oxidative/resination treatments cause a change in the base shade of the wool, the treated fibre becoming yellower. This limits the range of shades that can be shrink resist treated. The process of the invention causes virtually no alteration in shade of the base fibre, and this allows greater flexibility of choice when treating pre-dyed wool.

Oxidative treatments modify the surface of wool fibres and cause a reduction in dye fastness. The process of the invention causes no change in dye fastness and, therefore, allows greater flexibility when selecting dyes.

In addition, the sequential application of two different resins according to the invention produces a more durable non-felting finish which can be achieved with a greater degree of reliability and reproduceability than by application of a single polymer or by simultaneous application of polymer systems.

It should be understood that the wool containing material to be treated is preferably made of textile fibers and may be pure wool which may be blended with other materials such as polyamides, polyesters, polyacrylonitrile and cellulosic materials. Fabrics of fibers mixtures of wool and polyamides and above all knitted wool fabrics are particularly suitable to be treated according to the inventive process.

The invention is illustrated by the following Examples, in which all indicated percentages are percent by weight and in which the following enumerated products are used, Products ($A_1$), ($B_1$) and ($C_1$) being specific embodiments of the polymers (A), (B) and (C) and Product ($A_1'$) being a specific embodiment of a cross-linking compound (A') which may be used in conjunction with polymers (A). Product($A_1''$) is a specific embodiment of an organometallic compound used as a catalyst and exhaustion aid in conjunction with Polymer ($A_1$).

Product ($A_1$) is an aqueous non-ionic emulsion of an alkylamino substituted dimethyl polysiloxanediol (35% solids).

Product ($A_1'$) is an aqueous cationic emulsion of a methylhydrogenpolysiloxane (35% solids).

Product ($A_1''$) is an aqueous solution of triethanolamine titanate.

Product ($B_1$) is a poly(alkylene) oxide polythiol prepolymer produced by reacting 4 moles of thiomalic acid with 3 moles of poly(n-butylene oxide) diol, and available as a 66% solution in 2-ethoxyethanol.

Product ($C_1$) is an aqueous solution of a polyamide epichlorohydrin resin (11% solids) which is obtained by reacting 1.2 moles of diethylene triamine, 0.2 mole of dicyandiamide, 1 mole of dimethyl adipate and 1.8 moles of epichlorhydrin.

Product ($C_2$) is an aqueous solution of a polyamido polyamide resin (30% solids) which is obtained by reacting together a condensation product of epichlorhydrin and bisphenol A, a mixture of palmityl-, stearyl- and oleylamine, and a polyethylene polyaminoamide from polymerised linoleic acid and triethylene tetramine at pH 4 in the presence of acetic acid.

EXAMPLE 1

Effect of the subsequent application of polyamide resins on the degree of shrink resistance offered by polysiloxanes Wool fabric knitted from 0.28 tex Shetland yarn is treated with:

9.0% Product ($A_1$)
0.25% Product ($A_1''$)
0.1125% Product ($A_1'$)

using the following technique:

The fabric is initially scoured to remove processing oils and other residues using a non-ionic detergent and sodium carbonate to produce an alkaline pH. After thorough rinsing to remove scouring residues, the wool is rinsed in cold dilute acid at pH 4.0 to 5.0. A fresh bath is prepared with a pH value in the range 5.0 to 6.0 and temperature in the range 30°–40° C. Product ($A_1'$) is added followed after 5 minutes by the addition of Product ($A_1$). Exhaustion of the polysiloxane onto the wool takes place and is completed and speeded up by the addition of Product ($A_1''$) When complete exhaustion of the polysiloxanes has been achieved, the fabric is divided into three parts which are then treated as follows:

(a) no further treatment
(b) the processing bath is adjusted to pH 9.0 (with dilute ammonia) and a temperature of 40° C.
10% Product ($C_1$) is added and exhausted over 20 minutes
(c) the processing bath is adjusted to pH 9.0 (with dilute ammonia) and a temperature of 40° C.
3.5% Product ($C_2$) is added and exhausted over 30 minutes.

The treated fabrics are allowed to stand for seven days to cure, and then subjected to a mechanical wash test to determine the degree of felting that occurs.

Tests are carried out in the International Cubex machine, using the I.W.S. TM 185 test (International Wool Secretariat Specification 128, Test Method No. 185 , Superwash Specification).

The results of the TM 185 test are indicated in the following Table I

TABLE I

| | % Area Felting Shrinkage | | |
|---|---|---|---|
| | 1 hour wash | 2 hours wash | 3 hours wash |
| Untreated Fabric | 25.6 | 48.6 | 56.6 |
| 9% Product ($A_1$) | 10.3 | 23.6 | 34.7 |
| 9% Product ($A_1$) followed by 10% Product ($C_1$) | −5.9 | 5.3 | 9.9 |
| 9% Product ($A_1$) followed by 3.5% Product ($C_2$) | −7.4 | 9.2 | 19.2 |

(negative values denote extension).

Improved control of fabric stability is achieved when the application of polysiloxane is followed by a polyamide resin.

Example 2

Effect of polyamide resin on the time of cure of polysiloxanes

Wool fabric knitted from 0.28 tex Shetland yarn is treated as described in Example 1, and subjected to the standard washing test (TM 185) after allowing to cure for 1, 4 and 7 days. The test results are indicated in the following Table II.

TABLE II

| | % Area Felting Shrinkage After 3 Hours Wash | | |
|---|---|---|---|
| | After Curing 1 day | After Curing 4 days | After Curing 7 days |
| 9% Product ($A_1$) | 49.7 | 30.7 | 34.7 |
| 9% Product ($A_1$) followed by 10% Product ($C_1$) | 48.6 | 12.9 | 10.0 |
| 9% Product ($A_1$) followed by 3.5% Product ($C_2$) | 26.1 | 19.9 | 19.2 |

The use of a polyamide resin accelerates the rate of cure. This is particularly noticed with the Product ($C_2$).

Example 3

Effect of subsequent adding different amounts of polyamide resin to the exhausted polysiloxane bath Wool fabric knitted from 0.28 tex Shetland yarn was treated as described in Example 1 with 9% Product ($A_1$) and then with varying amounts of either Product ($C_1$) or Product ($C_2$). The treated fabrics are subjected to the standard washing test (TM 185) after allowing to cure for one and seven days. The test results are indicated in the following Table III.

TABLE III

| 9% Product ($A_1$) followed by: | % Area Felting Shrinkage 1 Day Cure 1 Hr | 2 Hrs | 3 Hrs | 7 Days Cure 1 Hr | 2 Hrs | 3 Hrs |
|---|---|---|---|---|---|---|
| a. 2.5% Product ($C_1$) | 7.3 | 21.4 | 32.7 | −0.9 | 1.6 | 7.4 |
| b. 5.0% Product ($C_1$) | 5.0 | 19.9 | 33.8 | −1.7 | 1.8 | 6.9 |
| c. 10.0% Product ($C_1$) | 8.6 | 25.5 | 40.5 | −1.1 | 3.9 | 10.4 |
| d. 20.0% Product ($C_1$) | 7.4 | 23.5 | 36.5 | −0.5 | 6.8 | 19.0 |
| e. 1.7% Product ($C_2$) | 1.7 | 7.9 | 17.9 | 1.0 | 10.3 | 23.4 |
| f. 3.3% Product ($C_2$) | 5.2 | 10.1 | 17.5 | 2.1 | 6.2 | 18.2 |
| g. 6.6% Product ($C_2$) | 4.1 | 9.4 | 13.9 | 1.9 | 10.6 | 25.3 |

(Hr = hours wash)

The stability of the treated fabric is more sensitive to variation in the amount of Product ($C_1$) than is the case with Product ($C_2$). An optimum amount of Product ($C_1$) appears to produce better stability than that of Product ($C_2$). On the other hand, Product ($C_2$) appears to produce good control over felting shrinkage after only one day's cure.

Example 4

Wollen knitted fabric (Shetland type) is treated as in Example 1 with 9% Product ($A_1$) followed by Product ($C_1$), and compared for dimensional stability to washing in the standard washing test (TM 185) with fabric treated:

(a) with 9% Product ($A_1$) but no Product ($C_1$)

(b) with 5% Product ($C_1$) but no Product ($A_1$)

The TM 185 test results are indicated in the following Table IV.

TABLE IV

| | % Area Felting Shrinkage After Seven Days Curing 1 Hour wash | 2 Hours wash | 3 Hours wash |
|---|---|---|---|
| 9% Product ($A_1$) | 1.1 | 22.2 | 35.5 |
| 9% Product ($A_1$) followed by 5% Product ($C_1$) | −0.8 | −3.5 | −2.8 |
| 5% Product ($C_1$) | 4.6 | 18.8 | 28.6 |

The combinated application of Product ($A_1$) followed by Product ($C_1$) applied to wool fabric produces a much higher standard of shrink resistance than each of the two components if used alone.

Example 5

Wollen knitted fabric (Shetland type) is treated and tested as in Example 4 using different amounts of both Product ($A_1$) and Product ($C_1$). The results as indicated in the following Table V are obtained in the standard washing test TM 185.

TABLE V

| | % Area Felting Shrinkage After Seven Days Curing 1 Hour wash | 2 Hours wash | 3 Hours wash |
|---|---|---|---|
| 6% Product ($A_1$) | 15.4 | 21.6 | 54.1 |
| 9% Product ($A_1$) | 1.1 | 22.2 | 35.5 |
| 6% Product ($A_1$) followed by 5% Product ($C_1$) | −4.2 | −2.8 | −1.5 |
| 9% Product ($A_1$) followed by 5% Product ($C_1$) | −1.1 | −3.5 | −2.8 |
| 6% Product ($A_1$) followed by | −0.2 | −0.9 | 0 |

TABLE V-continued

| | % Area Felting Shrinkage After Seven Days Curing 1 Hour wash | 2 Hours wash | 3 Hours wash |
|---|---|---|---|
| 10% Product ($C_1$) | | | |
| 9% Product ($A_1$) followed by 10% Product ($C_1$) | −0.8 | −4.5 | −2.9 |

A reduction in the amount of Product ($A_1$), used in the absence of Product ($C_1$), causes a considerable increase in the felting characteristics of the wool. In contrast, a similar reduction in the Product ($A_1$) level, used in conjunction with the subsequent application of 5% or Product ($C_1$), results in virtually no alteration in wool felting characteristics.

Example 6

Wool fabric knitted from 0.28 tex Shetland yarn is treated, as described below, to determine the effect of applying Product ($C_1$) to wool previously treated with Product ($B_1$).

The fabric is initially scoured as in Example 1 to remove processing oils and other residues. After thorough rinsing, a fresh bath is prepared at 40° C. with 3 ml/l acetic acid (80%) to produce a liquor pH of 4. 1% Product ($B_1$) is dissolved in the minimum quantity of dilute ammonia (10% solution) and added to the processing bath. After circulating for 10 minutes, 3×0.5 g/l quantities of anhydrous calcium chloride are added to induce exhaustion of the Product ($B_1$). When complete exhaustion of Product ($B_1$) had been achieved, the temperature of the liquor is increased to 65° C. The pH is adjusted to 8.0 to 8.5 with ammonia and 1.0% of hydrogen peroxide (100 vol.) is added. The fabric is treated under these conditions for 20 minutes to achieve complete curing of the polymer.

Fabric treated in this way is subsequently treated as follows in a fresh bath:

(a) no further treatment (b) treated at pH 9.0 and 40° C. with 10% Product ($C_1$) for 20 minutes (c) treated with 2% Product ($A_1$) and 0.025% Product ($A_1'$) for 20 minutes at 40° C. at pH 6.0.

The treated fabrics are immediately subjected to a standard washing test (TM 185) to determine the degree of felting that occurs. The test results are indicated in the following Table VI.

TABLE VI

| | % Area Felting Shrinkage After 1 Hour wash | After 2 Hours wash | After 3 Hours wash |
|---|---|---|---|
| 1% Product ($B_1$) | 3.5 | 11.1 | 23.1 |
| 1% Product ($B_1$) followed by 2% Product ($A_1$) | 1.6 | 11.0 | 24.4 |
| 1% Product ($B_1$) followed by 10% Product ($C_1$) | 0.5 | 1.9 | 3.8 |

The fabric treated with Product ($B_1$) and Product ($C_1$) possesses a similar handle to that of Product ($B_1$) applied alone but with much improved resistance to felting. Fabric treated with Product ($B_1$) and Product ($A_1$) has a similar resistance to felting as that of fabric treated with Product ($B_1$) alone, but the handle is much softer and bulkier and there is complete absence of free thiol odour, even after vigorous rubbing.

Example 7

Effect of varying the amount of Product ($C_1$) applied in succession to a fixed amount of Product ($B_1$)

Wool fabric knitted from 0.28 tex Shetland yarn is treated as in Example 6 with 1% Product ($B_1$). The fabric is then subsequently treated with different amounts of Product ($C_1$) ranging from 0 to 20%.

The treated fabrics are subjected to the standard washing test (TM 185) to determine the degree of felting shrinkage obtained. The test results are indicated in the following Table VII.

TABLE VII

| | % Area Felting Shrinkage | | |
|---|---|---|---|
| | 1 hour | 2 hours | 3 hours |
| 1% Product ($B_1$) | 6.3 | 23.8 | 39.2 |
| 1% Product ($B_1$) followed by 2.5% Product ($C_1$) | 3.7 | 10.8 | 22.2 |
| 1% Product ($B_1$) followed by 5% Product ($C_1$) | −1.3 | 0.3 | 4.4 |
| 1% Product ($B_1$) followed by 10% Product ($C_1$) | 0.8 | 5.5 | 6.9 |
| 1% Product ($B_1$) followed by 20% Product ($C_1$) | 0.9 | 8.0 | 14.7 |

These results may be compared with those obtained in Example 3, and indicates that the optimum quantity of Product ($C_1$) applied to both polysiloxane or poly (alkylene) oxide treated wool lies in the range 5 to 10% (i.e. 0.5 to 1.0% solids).

Example 8

Effects produced on wool/polyamide half hose

80/20 and 55/45 wool/polyamide half hose are treated with 1.5% Product ($B_1$) as described in Example 6. Fabric treated in this way is subsequently treated as follows in a fresh bath.

(a) no further treatment (b) treated at pH 9.0 and 40° C. with 2.5% Product ($C_1$) for 20 minutes (c) treated with 1% Product ($A_1$) and 0.012% Product ($A_1'$) at pH 6.0 and 40° C. for 20 minutes.

The treated fabrics are subjected to a washing test (TM 185) in the Cubex machine with the results indicated in the following Table VIII

TABLE VIII

| | 80/20 Wool/Polyamide % Linear Felting Shrinkage after 1 hour | | 55/45 Wool/Polyamide % Linear Felting Shrinkage after 1 hour | |
|---|---|---|---|---|
| | Leg | Foot | Leg | Foot |
| 1.5% Product ($B_1$) | 12.5 | 9.5 | 4.7 | 4.6 |
| 1.5% Product ($B_1$) followed by 2.5% Product ($C_1$) | 2.4 | 6.7 | 4.5 | 2.8 |

TABLE VIII-continued

| | 80/20 Wool/Polyamide % Linear Felting Shrinkage after 1 hour | | 55/45 Wool/Polyamide % Linear Felting Shrinkage after 1 hour | |
|---|---|---|---|---|
| | Leg | Foot | Leg | Foot |
| 1.5% Product ($B_1$) followed by 1% Product ($A_1$) | 9.0 | 7.0 | 5.4 | 6.25 |

Both types of hose when treated with Product ($B_1$) followed by Product ($C_1$) possess a similar handle to that of hose treated with Product ($B_1$) alone. Hoses treated with Product ($B_1$) followed by Product ($A_1$) possess a fuller softer handle and the hoses exhibit improved stretch/recovery properties.

What is claimed is:

1. Process for treating wool containing material which comprises applying to the material in a first step an aqueous composition containing a total amount of 0.25 to 6 percent by weight of a first polymer which is (A) a dialkyl polysiloxane diol containing aminoalkyl groups or (B) a poly(alkylene oxide) polythiol, and in a second step an aqueous composition containing a total amount of 0.1 to 4 percent by weight of a second polymer which is different from the first polymer and which is (A) a dialkyl polysiloxane diol containing aminoalkyl groups, or (C) a polyamide resin, the indicated percentages being related to the solids content of the polymers in the compositions in relation to the weight of the material to be treated.

2. Process according to claim 1, in which the polyamide resin (C) is a polyamide epichlorhydrin resin or polyamido polyamide resin.

3. Process according to claim 1 which comprises applying polymer (A) as first resin in an amount of 0.5 to 6 percent by weight.

4. Process according to claim 1, which comprises applying polymer (B) as first resin in an amount of 0.25 to 4 percent by weight.

5. Process according to claim 1, which comprises applying polymer (A) as the second resin in an amount of 0.1 to 2 percent by weight.

6. Process according to claim 2, which comprises applying as polymer (C) a polyamide epichlorhydrin as second resin in an amount of 0.25 to 3 percent by weight.

7. Process according to claim 2, which comprises applying as polymer (C) a polyamido polyamide as second resin in an amount of 0.25 to 4 percent by weight.

8. Process according to claim 1 in which the two resins as sequentially used in the two separate steps are applied from separate baths.

9. Process according to claim 1, in which the two resins as sequentially used in the two separate steps are applied from the same bath.

10. Wool containing material treated by the process according to claim 1.

11. Material according to claim 10, consisting of textile fibers of pure wool or of mixtures of wool and textile fibers selected from the group consisting of polyester, polyamide, polyacrylonitrile and cellulose.

* * * * *